US006053119A

United States Patent [19]

Okubo et al.

[11] Patent Number: 6,053,119

[45] Date of Patent: Apr. 25, 2000

[54] LOWER THREAD AUTOMATIC SUPPLY DEVICE FOR A SEWING MACHINE

[75] Inventors: Tsutomu Okubo; Kazunori Katayama; Toshinobu Shinozuka, all of Tokyo, Japan

[73] Assignee: Juki Corporation, Tokyo, Japan

[21] Appl. No.: 09/168,760

[22] Filed: Oct. 8, 1998

[30] Foreign Application Priority Data

Oct. 8, 1997 [JP] Japan ..... 9-293613

[51] Int. Cl.[7] ..... D05B 59/04

[52] U.S. Cl. ..... 112/186

[58] Field of Search ..... 112/180, 186, 112/279; 242/473.8, 484.8

[56] References Cited

U.S. PATENT DOCUMENTS

| | | | |
|---|---|---|---|
| 5,606,927 | 3/1997 | Nakamura et al. | 112/186 X |
| 5,775,243 | 7/1998 | Kinoshita et al. | 112/186 |
| 5,787,826 | 8/1998 | Vezzoli | 112/186 |

*Primary Examiner*—Peter Nerbun
*Attorney, Agent, or Firm*—Morgan & Finnegan LLP

[57] ABSTRACT

In a lower thread automatic supply device, the delivery means 19 and other devices 12, 13 of a bobbin replacing device 14 are mounted through a support plate 22 so disposed as to be shifted outwardly of a sewing machine in the axial direction of a hook 15, thereby eliminating the possibility that cloth, dust, and oil dropping down from the hook 15 and feed dog can attach directly to the delivery means 19 and other devices 12, 13, so that the respective devices 19, 12 and 13 can be kept clean. Also, the delivery means 19 and other devices 12, 13 are disposed spaced apart from a sewing machine operator to thereby be able to eliminate the danger that, when handling the sewing machine, the operator can touch the delivery means and other devices. Further, the hold body 3 of the delivery means 19 can be contacted with a mounting reference surface 21 to thereby be able to facilitate and simplify the mounting operation of the delivery means 19, which in turn makes it possible to improve the mounting precision of the delivery means with respect the hook 15.

23 Claims, 9 Drawing Sheets

LOWER THREAD AUTOMATIC SUPPLY DEVICE FOR A SEWING MACHINE

BACKGROUND OF THE INVENTION

The present invention relates to a lower thread automatic supply device for use in a sewing machine which moves a bobbin case along a given passage to thereby replace a bobbin within a hook.

In a sewing machine which carries out a sewing operation using upper and lower threads, especially, in an industrial sewing machine which carries out a high-speed sewing operation, a bobbin with a lower thread wound therearound must be replaced frequently. Generally, when the lower thread is consumed, the operation of the sewing machine is stopped once and a bobbin case with a bobbin stored therein is taken out from a hook; and, after then, a series of operations are executed by hand; that is, a new lower thread is wound around the bobbin and the bobbin case storing therein the bobbin with the new lower thread wound therearound is mounted into the hook again, or a previously prepared bobbin with a lower thread wound therearound is stored into the bobbin case and the bobbin case is then mounted into the hook.

However, such manual winding operation of the lower thread around the bobbin as well as such bobbin case replacing operation are very inefficient, resulting in the lowered productivity. In view of this, in Unexamined Japanese Patent Application Publication No. Hie. 7-68071 (corresponding to U.S. Pat. No. 5,694,874), Unexamined Japanese Patent Publication Application No. Hei. 8-173671 (corresponding to U.S. Pat. No. 5,839,679) and the like, the present applicants propose a lower thread automatic supply device which is capable of carrying out automatically an operation to wind a lower thread around a bobbin as well as a bobbin case replacing operation.

In particular, a bobbin replacing device which is provided in the above-disclosed lower thread automatic supply device, as shown in FIGS. 9 and 10, includes bobbin case grip means which holds and releases a bobbin case 1 with a bobbin stored therein to thereby take out a bobbin case within a hook and mount the same again into the hook; and, in more particular, the bobbin replacing device is structured such that the present bobbin grip means can be moved by delivery means 2 along a given passage to thereby move the bobbin case 1 cyclically between a hook 15, a residual thread removing device 4, and a lower thread winding device 5.

And, when a bobbin replacement request is given, the bobbin case 1, which is disposed within the hook and on which the lower thread is consumed, is taken out from within the hook 15 by the bobbin case grip means and the thus taken-out bobbin case 1 is delivered to the residual thread removing device 4, where the thread left on the bobbin is removed completely. The bobbin case 1 storing a thus emptied bobbin therein is delivered to the lower thread winding device 5, where a new lower thread is wound around the empty bobbin. After then, the bobbin with the new lower thread wound therearound is mounted into the hook 15 together with the bobbin case 1.

The thus structured conventional lower thread automatic supply device is disposed just under the hook 15; and, in particular, the components of the conventional lower thread automatic supply device, that is, the residual thread removing device 4, the lower thread winding device 5, and the delivery means 2 of the bobbin replacing device are respectively arranged under the hook 15.

Also, the present conventional lower thread automatic supply device is structured in such a manner that it can be mounted onto and removed from a sewing machine main body; for example, the present conventional lower thread automatic supply device can be mounted onto and removed from a device support portion 7 disposed under a bed portion 6 on the sewing machine main body side and, when the present conventional lower thread automatic supply device is mounted, the above-mentioned components 2, 4 and 5 forming the present conventional lower thread automatic supply device are arranged such that they have their respective given position relations with respect to the position of the hook 15.

However, in the present conventional lower thread automatic supply device, since it is disposed under the hook 15 of the sewing machine, not only cloth dust dropping down from a feed dog or the like of the sewing machine and thread trim scraps produced in a thread trimming device of the sewing machine can drop down onto the delivery means 2 and various sensor portions and can be easily attached thereto, but also lubrication oil supplied to the hook 15 can drop down or fly around so that it can stick to the delivery means 2 and various sensor portions. Due to this, the above-mentioned cloth dust and thread trim scraps can accumulate thereon in the form of sludge, which can cause the device to malfunction.

Also, in this type of conventional lower thread automatic supply device, unless the position relation thereof with respect to the hook position of the sewing machine, especially, with respect to the axis of the hook is set properly, then the mounting and removal of the bobbin case by the bobbin case grip means cannot be carried out positively. For this reason, when installing the conventional lower thread automatic supply device, there are required troublesome adjusting the setting operations for securing position precision. Further, in the conventional lower thread automatic supply device, the mounting relation thereof varies according to the kinds (head portions) of the sewing machines, and separately structured devices must be prepared to cope with the different kinds of the sewing machines.

Still further, in the conventional lower thread automatic supply device, after it is mounted, in accordance with the kinds (head portions) of the sewing machines or in accordance with the dimensional tolerances and assembling tolerances of individual sewing machines, the movement control amount of the delivery means must be adjusted, which makes it necessary to carry out an operation in which the position data (adjusting parameters) thereof stored in a control board provided externally of the lower thread automatic supply device are replaced and stored again.

SUMMARY OF THE INVENTION

The present invention aims at eliminating the above-mentioned drawbacks found in the conventional lower thread automatic supply device. Accordingly, it is an object of the invention to provide a lower thread automatic supply device which can be operated properly and stably for a long period of time, can be mounted onto a sewing machine main body easily and accurately, and can be easily adjusting in position after it is mounted.

In achieving the above object, according to a first aspect of the invention, there is provided a lower thread automatic supply device for a sewing machine having a sewing machine bed and a hook below the sewing machine bed to accommodate a bobbin case with a bobbin, the lower thread automatic supply device comprising: a bobbin replacing device including bobbin case-mounting and removing means for mounting the bobbin case onto the hook of the sewing machine and for removing the bobbin case from the hook, and delivery means for moving the bobbin case between the hook and a position spaced apart from the hook; first fixing means disposed at a given position on the sewing machine bed with the hook used as reference therefor; and a hold body including second fixing means to be fixed to the first fixing means, wherein the bobbin case-mounting and removing means and the delivery means of the bobbin replacing device are fixedly disposed at their respective given positions with the second fixing means as reference therefore, wherein, if the first and second fixing means are fixed together, then the bobbin case-mounting and removing means and the delivery means of the bobbin replacing device fixedly disposed on the hold body are fixed at their respective given positions with the hook as reference therefor.

Also, according to a second aspect of the invention, in the lower thread automatic supply device as described above, the hold body is formed as a unit which is structured such that the bobbin replacing device is disposed farther on the opposite side of the sewing machine operator than the hook.

Further, according to a third aspect of the invention, in the lower thread automatic supply device of the first aspect, the first fixing means is provided directly on the sewing machine bed, and the second fixing means includes an opening which can provide an open space at least in front of the hook.

Still further, according to a fourth aspect of the invention, in a lower thread automatic supply device of the first aspect, the first fixing means includes an opening which can provide an open space at least downwardly of the hook, and the first fixing means is also structured such that it allows the hold body to be disposed at a position spaced apart from the hook in the hook axial direction.

Yet further, according to a fifth aspect of the invention, in the lower thread automatic supply device of the first aspect, in the first fixing means, there is provided a mounting reference surface, and the second fixing means is contacted with the present mounting reference surface to thereby enable rotation of the moving shaft of the delivery means to be disposed at a position having a given position based on the position of the hook.

And, according to a sixth aspect of the invention, there is provided a lower thread automatic supply for a sewing machine having a hook to accommodate a bobbin case with a bobbin, the lower thread automatic supply device comprising: a bobbin replacing device including bobbin case grip means for holding and releasing the bobbin case, and delivery means for moving the bobbin case between the hook and other devices, the delivery means of the bobbin replacing device being structured such that the delivery means rotates the bobbin case grip means about a given rotation moving shaft extending almost in parallel to the axis of the hook to thereby move the bobbin replacing device and also that the delivery means moves the bobbin case grip means linearly along the present rotation moving shaft, wherein the rotation moving shaft of the delivery means and the other devices are disposed spaced apart on the opposite side of a sewing machine operator from a position just under the hook; a hold body is disposed spaced apart by a given amount from the hook position toward the sewing machine outward side of the rotation moving shaft of the delivery means, and the delivery means is mounted on the hold body from the sewing machine outward side; and a mounting reference surface for mounting the hold body is provided on the sewing machine main body side, and the hold body is contacted with the mounting reference surface to thereby dispose the rotation moving shaft of the delivery means at a position having a given position relation with respect of the hook position.

Also, according to a seventh aspect of the invention, in the lower thread automatic supply device of the sixth aspect, the other devices include a residual thread removing device for taking out a residual thread left on a bobbin stored within the bobbin case, and a lower thread winding device for winding a given amount of lower thread around the bobbin, and also wherein the residual thread removing device and lower thread winding device are respectively disposed spaced apart from the position just under the hook on the opposite side of a sewing machine operator.

Further, according to an eighth aspect of the invention, in the lower thread automatic supply device of either fifth of sixth aspect of the invention, the mounting reference surface includes an axial direction reference surface for positioning the delivery means in the direction of the axis of the hook, a height direction reference surface for positioning the delivery means in the vertical direction thereof within a plane intersecting the hook axis at right angles, and a longitudinal direction reference surface for positioning the delivery means in the depth direction thereof within the plane intersecting the hook axis at right angles.

Still further, according to a ninth aspect of the invention, in the lower thread automatic supply device of either second or sixth aspect of the invention, the bobbin replacing device includes a control amount setting and storing portion for setting the position relations of the respective parts of the bobbin replacing device with respect to the hook.

According to the lower thread automatic supply device of the first aspect, the hold body for holding the bobbin replacing device is fixed to the bed side fixing means provided on the sewing machine bed side, so that the respective means of the bobbin replacing device can be disposed with high precision with respect to the hook and thus the bobbin case can be mounted onto and removed from the hook with accuracy.

And, according to the lower thread automatic supply device as set forth in the second aspect, since the lower thread automatic supply device is disposed in such a manner that it is shifted toward the deep side of the sewing machine, there is eliminated the possibility that the cloth dust or oil dropping down form the hook and feed dog can attach directly onto the lower thread automatic supply device. This not only can keep the lower thread automatic supply device clean but also can facilitate the maintenance of the hook and other similar operations. Also, because the lower thread automatic supply device is formed as a unit, the assembling and replacing operations of the lower thread automatic supply device with respect to the sewing machine side can be facilitated.

Also, according to the lower thread automatic supply device as set forth in the third aspect, because an operation space for the hook can be secured more sidely, not only operations to be performed on the hook such as the maintenance thereof and the like can be facilitated further but also the structure of the lower thread automatic supply device can be simplified.

Further, according to the lower thread automatic supply device as set forth in the fourth aspect, since the lower thread automatic supply device is disposed in such a manner that it is shifted toward the outside of the sewing machine, there is eliminated the possibility that the cloth dust or oil dropping down form the hook and feed dog can attach directly onto the lower thread automatic supply device. This not only can keep the lower thread automatic supply device clean but also can secure a wide open space in front of the hook to thereby facilitate the maintenance of the hook and other similar operations.

Still further, according to the lower thread automatic supply device as set forth in the fifth aspect, simply by bringing the hold body side fixing means into contact with the mounting reference surfaces on the sewing machine main body side to thereby mount the former onto the latter, the delivery means can be disposed with high precision with respect to the hook.

Yet further, according to the lower thread automatic supply device as set forth in the sixth aspect, because the bobbin replacing device and other devices are respectively disposed in the hold body that is so disposed as to be shifted toward the outside of the sewing machine in the hook axial direction, there is eliminated the possibility that the cloth dust or oil dropping down from the hook and feed dog can attach directly onto the delivery means of the bobbin replacing device and other devices. This can keep clean the delivery means of the bobbin replacing device and other devices.

Also, since the delivery means of the bobbin replacing device and other devices are spaced apart from the sewing machine operator, not only operations to be executed on the hook such as the maintenance thereof and the like can be facilitated, but also there is eliminated the danger that, when handling the sewing machine, the sewing machine operator can touch the delivery means of the bobbin replacing device and other devices. In addition to this, simply by bringing the hold body on the delivery means of the bobbin replacing device into contact with the mounting reference surfaces on the sewing machine main body side to thereby mount the former onto the latter, the delivery means can be positioned with high precision with respect to the hook.

And, according to the lower thread automatic supply device as set forth in the seventh aspect, in the lower thread automatic supply device of the sixth aspect, in addition to the delivery means of the bobbin replacing device, the residual thread removing device and lower thread winding device are respectively mounted on the hold body that is to disposed as to be shifted toward the outside of the sewing machine in the hook axial direction, so that the residual thread removing device and lower thread winding device are so disposed as to be shifted toward the deep side of the sewing machine. This eliminates the possibility that the cloth dust and oil dropping down from the hook and feed dog can attach directly to the residual thread removing device and lower thread winding device, which in turn makes it possible to keep clean the residual thread removing device and lower thread winding device.

Also, since the residual thread removing device and lower thread winding device are spaced apart from the sewing machine operator, not only operations to be executed on the hook such as the maintenance thereof and the like can be facilitated, but also there is eliminated the danger that, when handling the sewing machine, the sewing machine operator can touch the residual thread removing device and lower thread winding device. In addition to this, simply by bringing the hold body on the residual thread removing device and lower thread winding device into contact with the mounting reference surfaces on the sewing machine main body side to thereby mount the former onto the latter, the residual thread removing device and lower thread winding device can be respectively positioned with high precision with respect to the hook.

Also, according to the lower thread automatic supply device of the eighth aspect, the bobbin replacing device, residual thread removing device and lower thread winding device can be positioned with high precision in the hook axial direction, in the height direction and in the depth direction.

Further, according to the lower thread automatic supply device of the ninth aspect, the position of the lower thread automatic supply device can be adjusted by itself by operating the control amount setting and storing portion provided in the interior portion thereof.

DETAILED DESCRIPTION OF THE PREFERRED EMBODIMENTS

Figure 1:
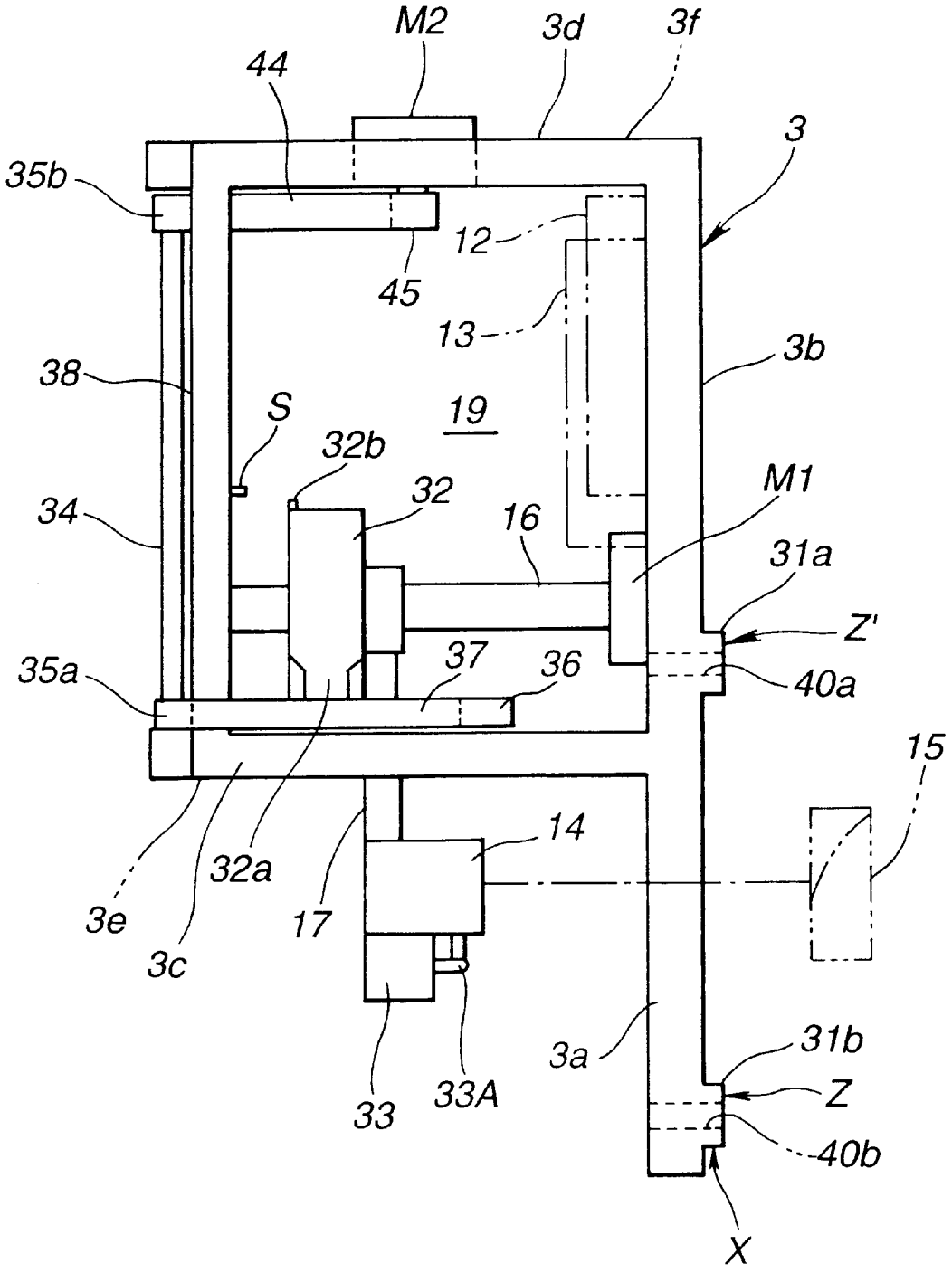
FIG. 1 is an explanatory plan view of an embodiment of a lower thread automatic supply device according to the invention.

Now, description will be given below in detail of the preferred embodiments of a lower thread automatic supply device according the invention with reference to the accompanying drawings.

A lower thread automatic supply device according to a first embodiment of the invention, as shown in FIGS. 1, 2, 3 and 5, is united integrally to the interior portion of a hold body 3. That is, the hold body 3 comprises a support part 3*a* formed of a plate-shaped member to be fixed to a sewing machine bed frame 11 (which will be discussed later), a hold part 3*b* which extends from the support part 3*a* laterally toward the deep side of the sewing machine and is used to hold a lower thread winding device 12, a residual thread removing device 13 (which will be discussed later) and the like, upper beam parts 3*c* and 3*d* which respectively extend from the upper ends of the support part 3*a* and hold part 3*b* toward this side in a hook axial direction, lower beam parts 3*e* and 3*f* which respectively extend from the lower ends of the support part 3*a* and hold part 3*b* toward this side in the hook axial direction, and an upper side beam part 3*g* for connecting the upper beam parts 3*c* and 3*d* to each other, and the like.

Also, the support part 3*a* and hold part 3*b* respectively include projecting portions 31*a* and 31*b* which not only, when mounting the present lower thread automatic supply device onto a sewing machine facing hook 15, provide the side of the sewing machine but also cooperate together in forming fixing means; and, in these projecting portions 31*a* and 31*b*, there are formed holes 40*a* and 40*b* through which mounting screws 39*a* and 39*b* can be inserted respectively. Further, in the support part 3*a*, there is formed an opening 3*h* which, when mounting the present lower thread automatic supply device onto the sewing machine bed 11, allows the front portion of the hook 15 to open (see FIG. 5).

And, to the inside end face (located on the opposite side of the hook 15) of the hold part 3*b*, there is fixed a stepping motor M1. A drive shaft 16 is connected to the stepping motor M1 in such a manner that it can be rotationally driven by the stepping motor M1, while the leading end portion of the drive shaft 16 is supported by the upper side beam part 3*g* and the drive shaft 16 is disposed in parallel to the axis of the hook 15. On the drive shaft 16, there is mounted a drive arm 17 in such a manner that it is prevented against rotation but can be slided in the axial direction of the drive shaft 16; and, a bearing 32, which is formed integrally with the drive arm 17, is also mounted on the drive shaft 16 in such a manner that it can be rotated and slid with respect to the drive shaft 16. The stepping motor M1, drive shaft 16, drive arm 17 and the like cooperate together in forming delivery means 19.

On the leading end of the drive arm 17, there is fixed a solenoid 33 and, further, there is fixed and supported a bobbin replacing device 14 disclosed in Unexamined Japanese Patent Application Publication No. Hei. 8-191978 (corresponding to U.S. Pat. No. 5,718,181) which has been previously filed by the present applicant. The bobbin replacing device 14, when energized by the solenoid 33, can grip an opening pawl (not shown) of a bobbin case 18 through a link mechanism 33A and, when de-energized, can release the opening pawl. That is, the bobbin replacing device 14 has such a function that it can move in the hook axial direction with respect to the lower thread winding device 12 or residual thread removing device 13 and, due to this movement, can take out the bobbin case 18 to hold it or mount it onto the lower thread winding device 12 or residual thread removing device 13.

The hold body 3 further includes a connecting shaft 34 the two ends of which are rotatably supported by the upper beam parts 3*c* and 3*d*; gears 35*a* and 35*b* are respectively fixed to the two ends of the connecting shaft 34; and, between the gear 35*a* and a gear 36 rotatably supported on the upper beam part 3*c*, there is bridgingly interposed a timing belt 37. To the outer peripheral portion of the timing belt 37, there is fixed a securing portion 32*a* of the bearing 32. On the other hand, on the upper beam part 3*d*, there is fixedly mounted a stepping motor M2 and also there is rotatably supported a gear 45 which can be driven by the stepping motor M2; and, between the gear 45 and gear 35*b*, there is bridgingly interposed a timing belt 44. Accordingly, the timing belt 37 can be operated through the connecting shaft 34 to thereby move the bearing 32 and drive arm 17 (bobbin replacing device 14) in the hook axial direction.

The bearing 32 includes a projecting portion 32*b* in the outer peripheral portion thereof and, when the projecting portion 32*b* approaches a limit switch S provided on the upper side beam part 3*g*, detection is made.

The lower thread winding device 12 has such a structure as disclosed in Unexamined Japanese Patent Application Publication No. Hei. 8-229262 (corresponding U.S. patent application Ser. No. 08/548,237, now U.S. Pat. No. 5,839,679, which can carry out the following step automatically: that is, a thread is twined around a bobbin stored within a bobbin case by means of rotation of the bobbin before the thread is wound around the bobbin, the rotation of the bobbin is caused to stop when the thread is wound by a given amount, and, after then, the thread is inserted below a lower thread tension spring provided in the bobbin case.

The residual thread removing device 13, as disclosed in Unexamined Japanese Patent Application Publication No. Hei. 8-191976 (corresponding to U.S. patent application Ser. No. 08/560,307), is structured such that, when the leading end of the lower thread left in the bobbin within the bobbin case taken out from the hook 15 hangs down from the bobbin case, a pair of rollers hold the hanging-down leading end of the lower thread between them and, because at least one of the two rollers is driven to thereby rotate the two rollers, the lower thread can be played out and removed from the bobbin due to such rotation of the two rollers.

The bobbin replacing device 14 is structured such that it can be moved by the stepping motor M2 sequentially to the lower thread winding position 12*a* of the lower thread winding device 12, the residual thread removing position 13*a* of the residual thread removing device 13 and the position of the hook 15 along a locus of rotation with the drive shaft 16 as a center thereof.

Figure 5:
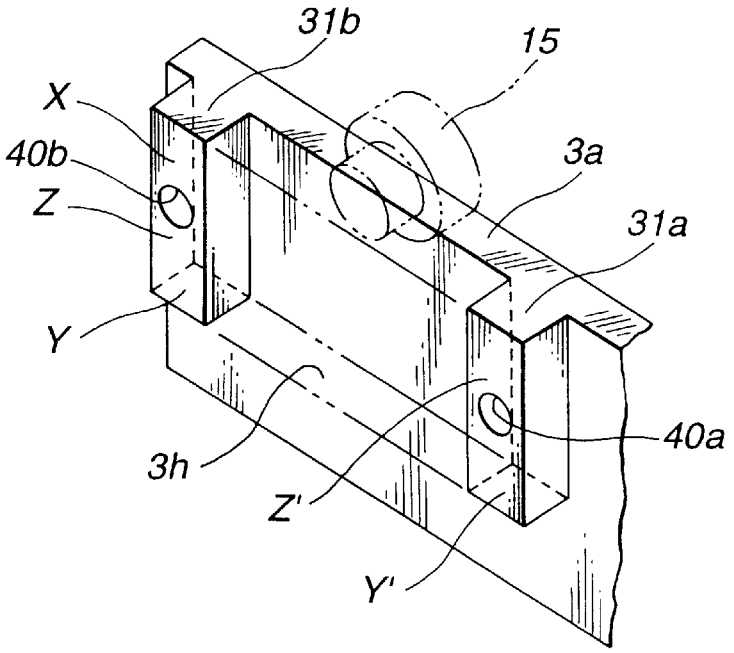
FIG. 5 is an explanatory perspective view of the appearance of a hold body to be fitted with the mounting part shown in FIG. 3, showing the structure of surfaces provided in the hold body.

As shown in FIG. 5 as well, in the projecting portions 31*a* and 31*b* that are respectively provided on the hold body 3, there are provided, as mounting reference surfaces, projection end faces Z, Z', a projection side face X, and projecting bottom surfaces Y, Y'; that is, with these surfaces as reference, the respective positions of the drive shaft 16, the lower thread winding position 12*a*, the residual thread removing position 13*a* and the like on the hold body 3 are set.

Figure 4:
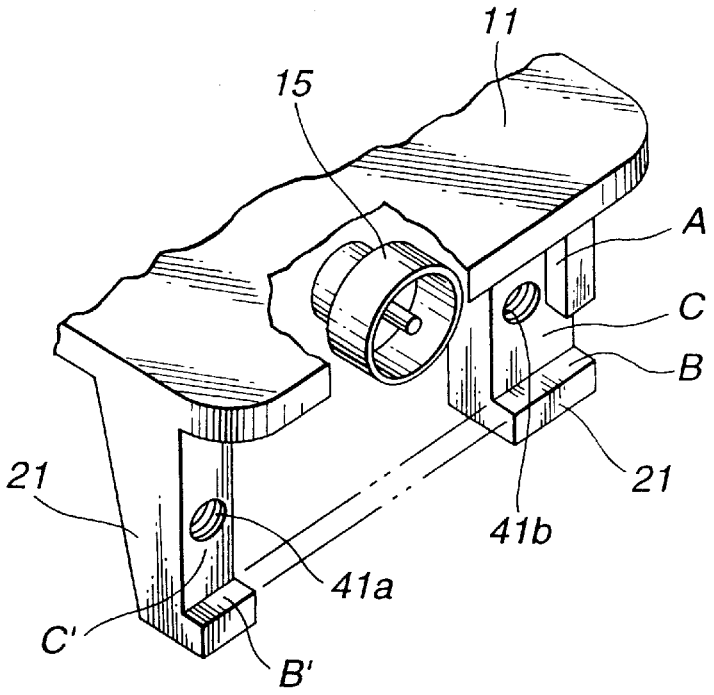
FIG. 4 is an explanatory perspective view of the appearance of a mounting part provided on the sewing machine main body side, showing the structure of reference surfaces provided in the mounting part.

On the other hand, as shown in FIG. 4, in the portion of the sewing machine bed 11 of the sewing machine main body where the hook 15 is provided, there are formed integrally therewith a pair of foot-shaped mounting parts 21 (fixing means) in such a manner that they extend downward from the sewing machine bed 11. The present mounting parts 21 cooperate together in constituting bed-side fixing means and include screw holes 41*a* and 41*b* which respectively communicate with the holes 40*a* and 40*b* formed in the hold body 3 also into which screws 39 and 39' can be threadedly inserted. The screw holes 41*a* and 41*b* are set at such positions with respect to the axis of the hook 15 that mounting reference surfaces A, B and C (which will be discussed later) can be set at their respective given positions.

Figure 2:
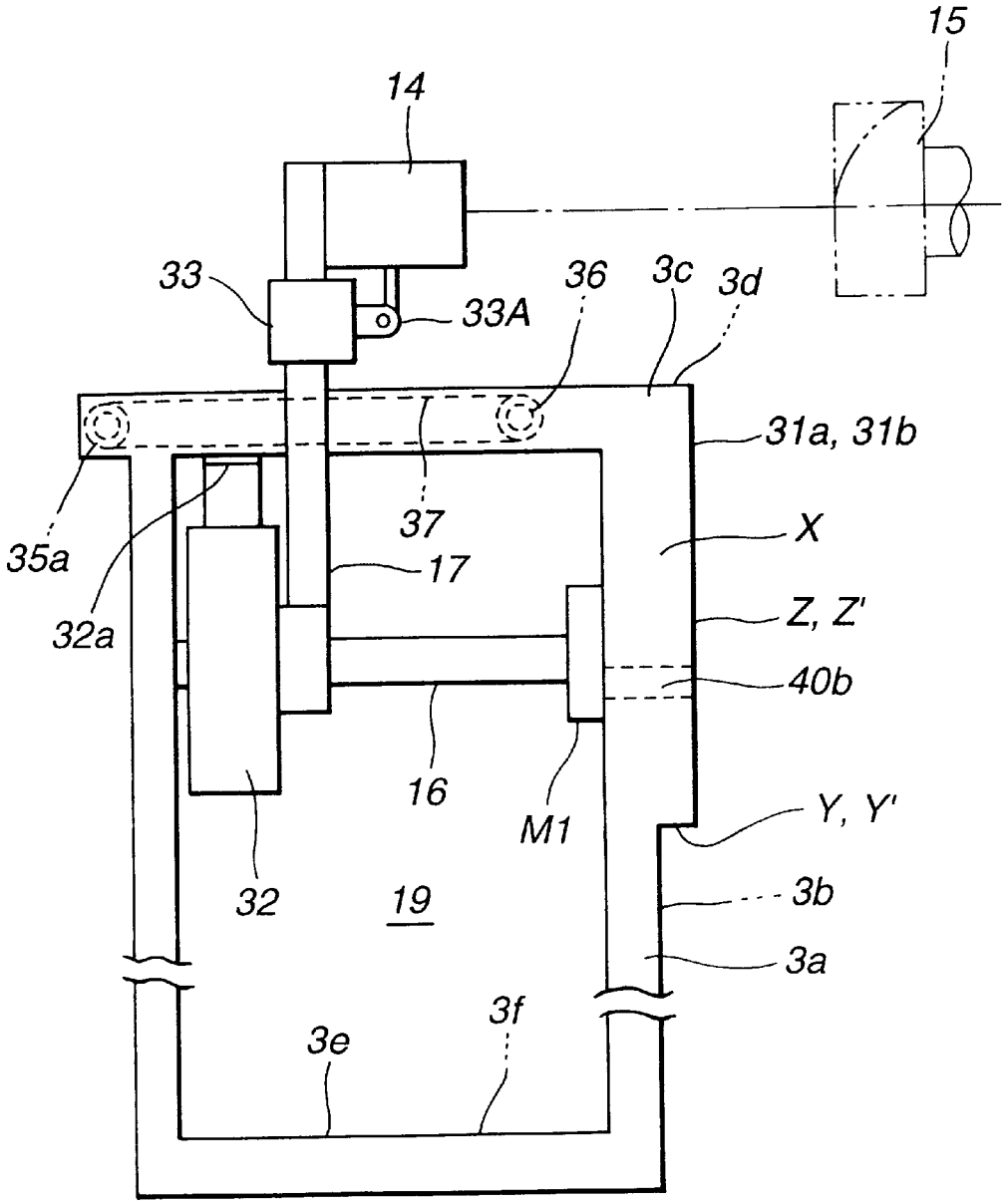
FIG. 2 is an explanatory plan view of the lower thread automatic supply device shown in FIG. 1.

In this case, the hold part 3*b* of the hold body 3 is set such that it is distant, in the axial direction of the hook 15, by a given amount in the sewing machine outward direction (in the left direction in FIGS. 1 and 2) from the position just under the hook 15; and, the delivery means 19 is mounted on the present hold part 3*b* from the sewing machine outward direction (from the left direction in FIGS. 1 and 2). For this reason, the delivery means 19 of the bobbin replacing device 14 is not disposed at a position just under the hook 15 but the provision space for the delivery means 19 on the sewing machine outward side is cut off from a space existing at the position just under the hook 15 by the hold part 3*b*.

Also, the hold part 3*b* is formed such that it extends long on the deep side from the position just under the hook 15 toward the opposite side of a sewing machine operator and, in correspondence to this, the center position 16*a* of the rotary moving shaft 16 of the delivery means 19 is set such that it is shifted slightly on the deep side from the position just under the hook 15 toward the opposite side of the sewing machine operator. Also, the residual thread removing device 13 and lower thread winding device 12 are also set such that they are shifted slightly on the deep side from the position just under the hook 15 toward the opposite side of the sewing machine operator. That is, the delivery means 19 of the bobbin replacing device 14, residual thread removing device 13 and lower thread winding device 12 are set such that they are not present at the position just under the hook 15.

On the other hand, as shown in FIG. 4, in the mounting parts 21 and 21 of the sewing machine head 11, there are formed axially-extending reference surfaces C, C' respectively engageable with the projection end faces Z, Z' of the projecting portions 31*a*, 31*b* of the hold body 3, a longitudinally-extending reference surface A engageable with the projection side surface X, and height-direction-extending reference surfaces B, B' respectively engageable with the projection bottom surfaces Y, Y'. These reference surfaces are respectively positioned in such a manner that they have their respective given distances or rotation-direction positions (θ) with respect to the axis of the hook 15; and, in order to secure the position accuracy, these references surfaces are finished as flat surfaces and they are also finished in such a manner that they intersect one another at right angles.

And, if the projection end faces Z, Z' of the projecting portions 31*a*, 31*b* of the hold body 3 are respectively contacted with the axially-extending reference surfaces C, C' of the mounting parts 21, then the delivery means 19 can be positioned in the hook axial direction and, at the same time, if the projection side wall surface X is contacted with the longitudinally-extending reference surface A, then the delivery means 19 can be positioned in the depth direction. Also, if the lower end faces Y, Y' of the two projecting portions 31*a*, 31*b* on the delivery means 19 side are respectively contacted with the height-direction-extending reference surfaces B, B' of the mounting parts 21, then the delivery means 19 can be positioned not only in the vertical direction but also in the rotation direction with respect to the axis of the hook 15.

Figure 3:
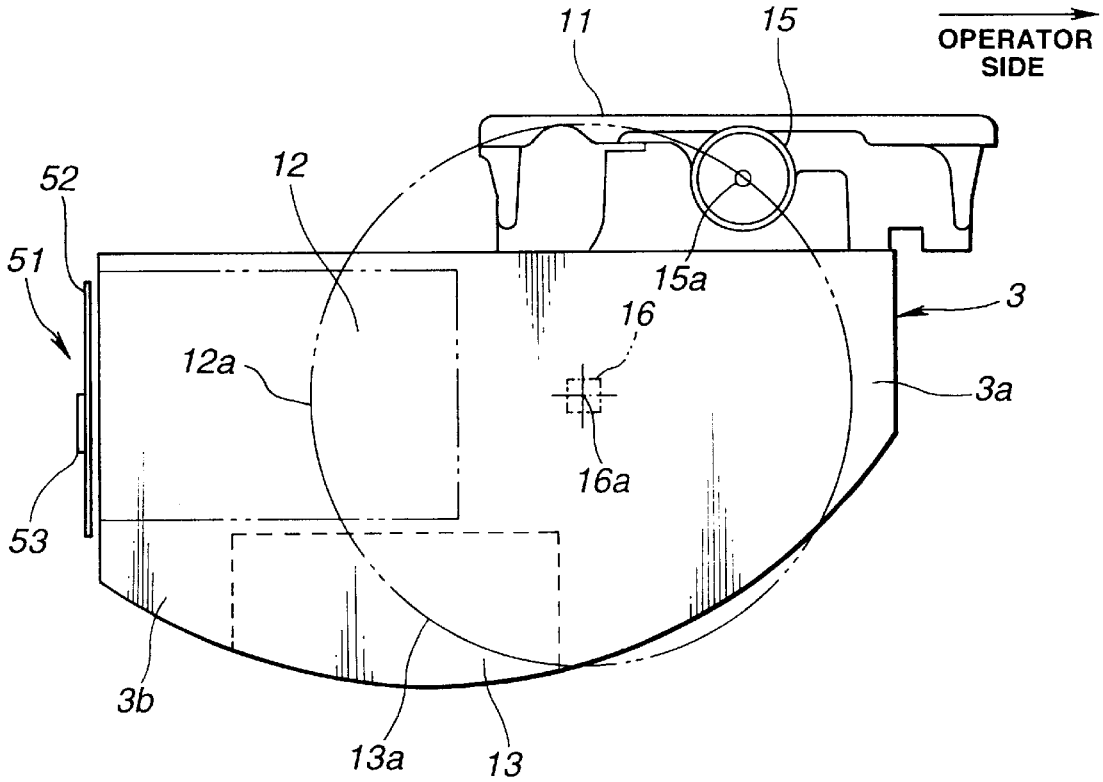
FIG. 3 is an explanatory front view of the lower thread automatic supply device shown in FIG. 1.

Further, as especially shown in FIG. 3, the bobbin replacing device 14 according to the present embodiment includes a control amount setting and storing part 51 which is used to set the position relations of the respective parts with respect to the hook 15. The present control amount setting and storing part 51 includes a substrate 52 and a memory element 53 mounted on the substrate 52. Basically, the control amount setting and storing part 51 sets the operation amount of the delivery means 19 of the bobbin replacing device 14 with respect to the positions of the hooks 15 which vary according to the kinds of the sewing machines; and also, the control amount setting and storing part 51 is capable of storing given position data (control parameters) so that, even in the same machine kind, it can control the operation amount to thereby match the mounting surfaces of the lower thread automatic supply device to the axis of the hook in accordance with the dimensional tolerances and assembling tolerances of the individual lower thread automatic supply devices, for example, the tolerances of the position sensor mounting positions or the like.

In the thus structured lower thread automatic supply device according to the present embodiment, not only the delivery means 19, residual thread removing device 13 and lower thread winding device 12 of the bobbin replacing device 14 are respectively positioned in such a manner that they are shifted from the position of the hook 15 of the sewing machine main body toward the deep side thereof, but also the delivery means 19 of the bobbin replacing device 14 is positioned in such a manner that it is shifted outwardly of the sewing machine in the axial direction of the hook 15. This structure eliminates the possibility that the cloth dust or oil dropping down from the port 15 and the feed dog side can be attached directly to the delivery means 19, residual thread removing device 13 and lower thread winding device 12. As a result of this, the delivery means 19, residual thread moving device 13 and lower thread winding device 12 can be kept clean and thus they can be operated properly and stably.

Similarly, since the delivery means 19, residual thread removing device 13 and lower thread winding device 12 are arranged apart from an operator of the sewing machine, there is eliminated the possibility that the operator, when handling the sewing machine, can touch the delivery means 19, residual thread removing device 13 and lower thread winding device 12, which makes it possible to prevent the possible damage of the devices as well as the possible injury of the operator. Further, the present structure can also facilitate the maintenance of the hook 15 or other similar operations.

Especially, according to the present embodiment, because the delivery means 19 of the bobbin replacing device 14 is mounted through the hold part 3*b* which is disposed such that it is shifted outwardly of the sewing machine in the axial direction of the hook 15, the delivery means 19 is shielded from the portion just under the hook 15 by the hold part 3*b*; that is, due to the shield function of the hold part 3*b*, the original performance of the delivery means 19 can be enhanced further.

Also, according to the present embodiment, by bringing the hold part 3*b* of the delivery means 19 of the bobbin replacing device 14 into contact with the mounting reference surfaces which are provided in the mounting parts 21 of the sewing machine main body and respectively extend in various directions, the lower thread automatic supply device is positioned with respect to the position of the hook 15. Due to this, the lower thread automatic supply device can be mounted with high precision and with ease.

Further, in the lower thread automatic supply device according to the present embodiment, by operating the control amount setting and storing part 51 provided in the interior portion of the present device, the position of the present device can be adjusted by the present device itself.

Although the embodiments of the present invention are described, the invention is not limited to the above-mentioned embodiment but, of course, various changes and modifications are also possible without departing from the scope of the subject matter of the invention.

For example, in the above-mentioned embodiment, the mounting parts 21 on the sewing machine main body side are formed integrally with the sewing machine bed 11 (see FIG. 4). However, this is not limitative but, as shown in FIGS. 6 to 8, a mounting structure members respectively including a similar mounting body 61 may be previously formed separately from the sewing machine main body and each of them may be used as an attachment for each kind of sewing machine.

Figure 6:
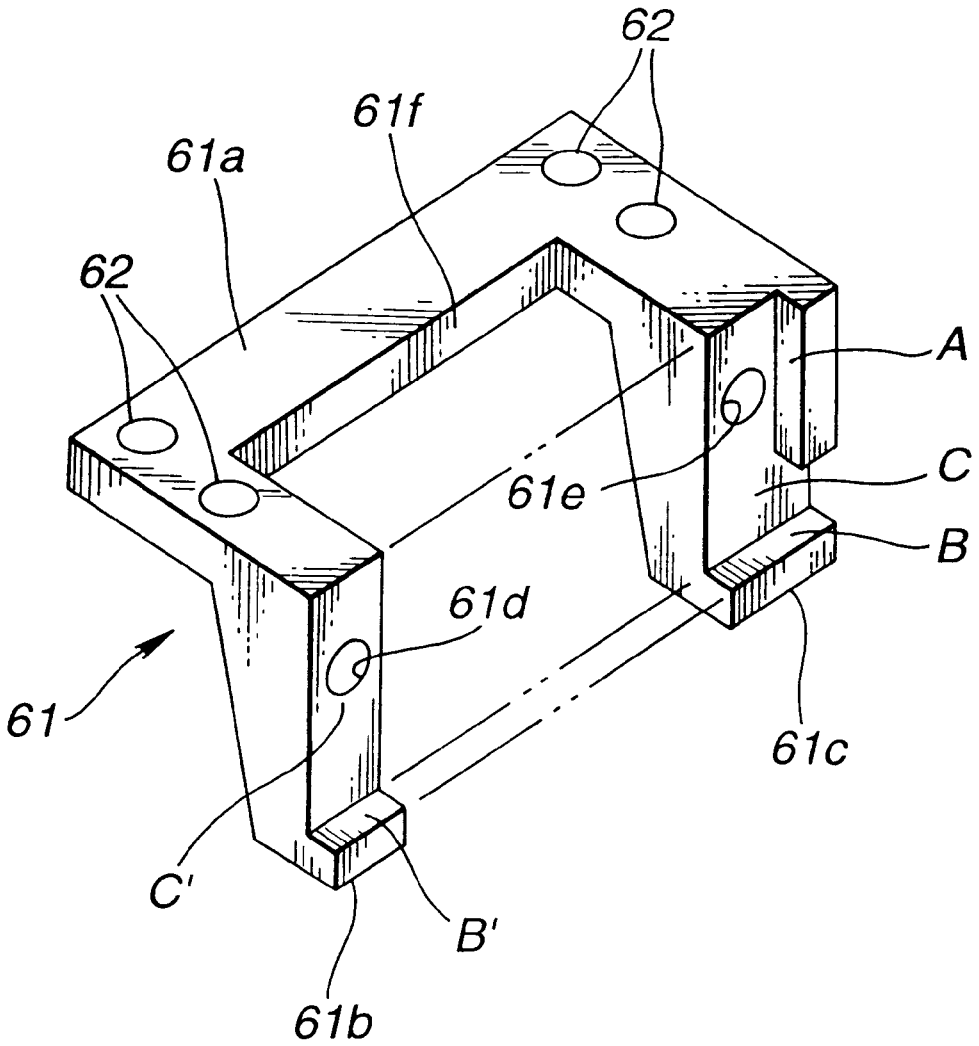
FIG. 6 is an explanatory perspective view of the appearance of a mounting body which is another embodiment of the above-mentioned mounting part.

This is, as shown in FIG. 6, the mounting body 61 includes in the two end portions of a mounting base plate 61*a* a pair of mounting portions 61*b* and 61*c* (fixing means) consisting of foot-shaped members which are spaced by a given distance from each other. In particular, the two mounting portions 61*b* and 61*c* respectively hang down from the mounting base plate 61*a* bent substantially in an L-shaped manner and also include screw holes 61*d*, 61*e* and mounting reference surfaces A, B and C which are similar to those formed in the mounting parts 21 in the above-mentioned embodiment. Also, the mounting body 61 includes not only an opening 61*f* which is open in the vertical direction as well as in the longitudinal direction thereof but also four support holes 62 which respectively extend through the mounting base plate 61*a* in the vertical direction thereof and also which are used to fix the mounting body 61 to the lower surface side of the sewing machine bed 11.

Figure 7:
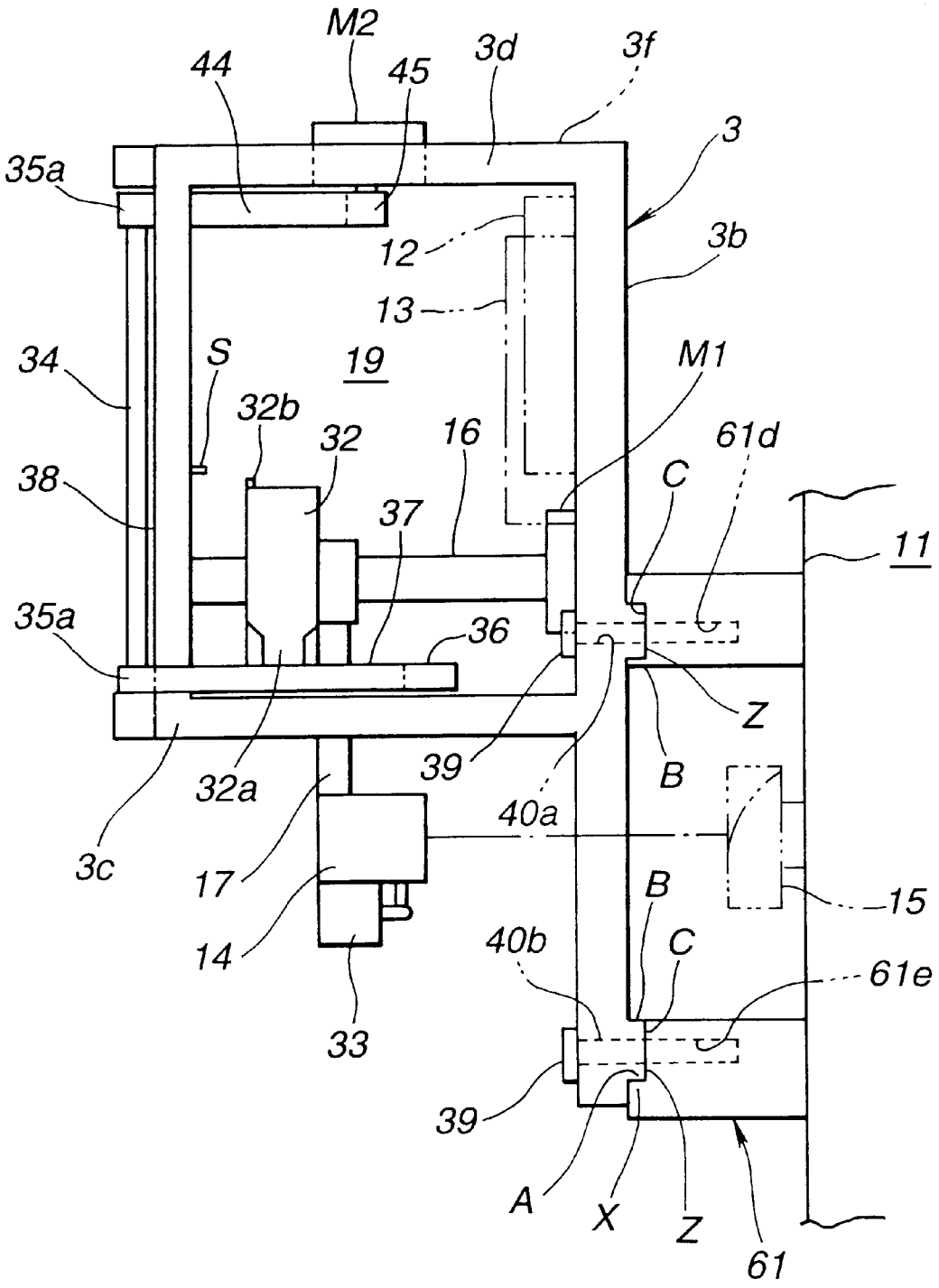
FIG. 7 is an explanatory plan view of the present lower thread automatic supply device mounted on the above mounting body.
Figure 8:
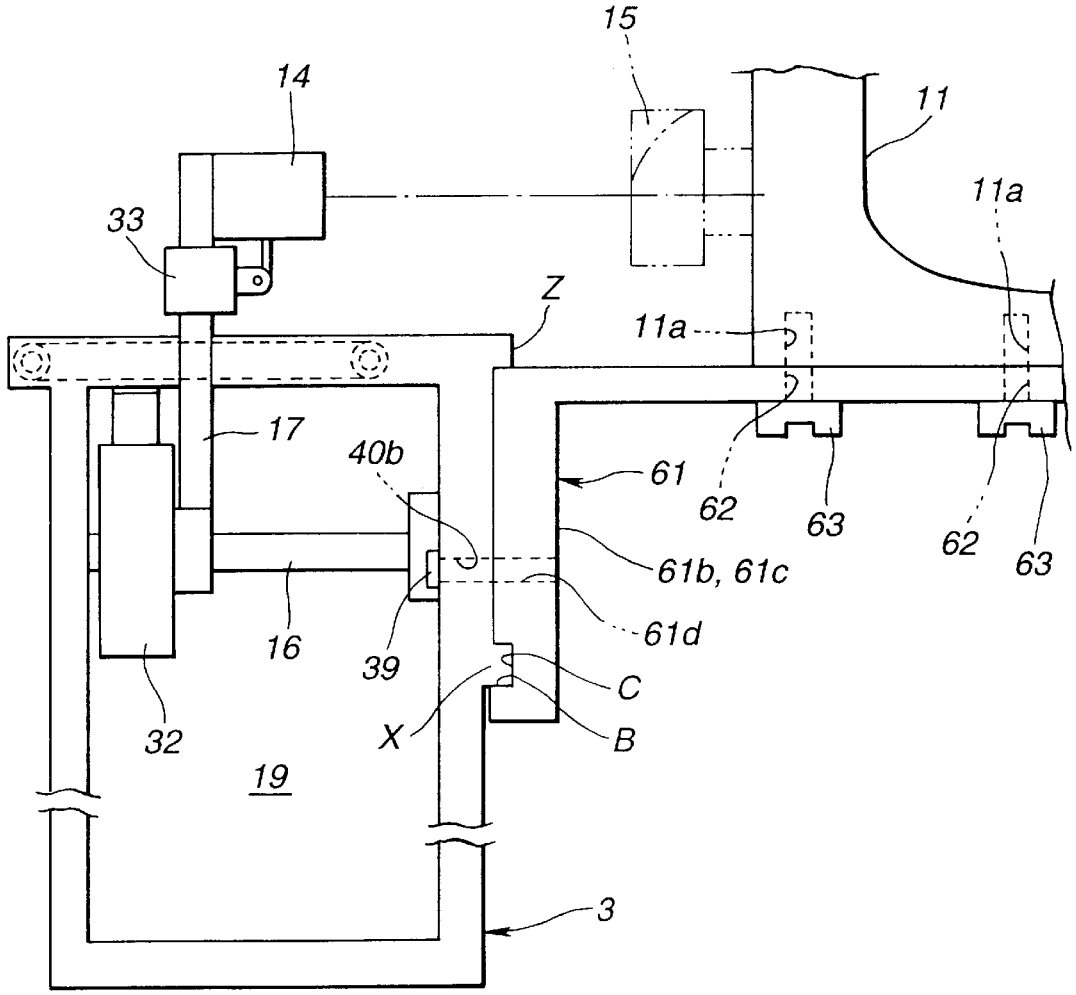
FIG. 8 is an explanatory side view of the present lower thread automatic supply device mounted on the above mounting body.
Figure 9:
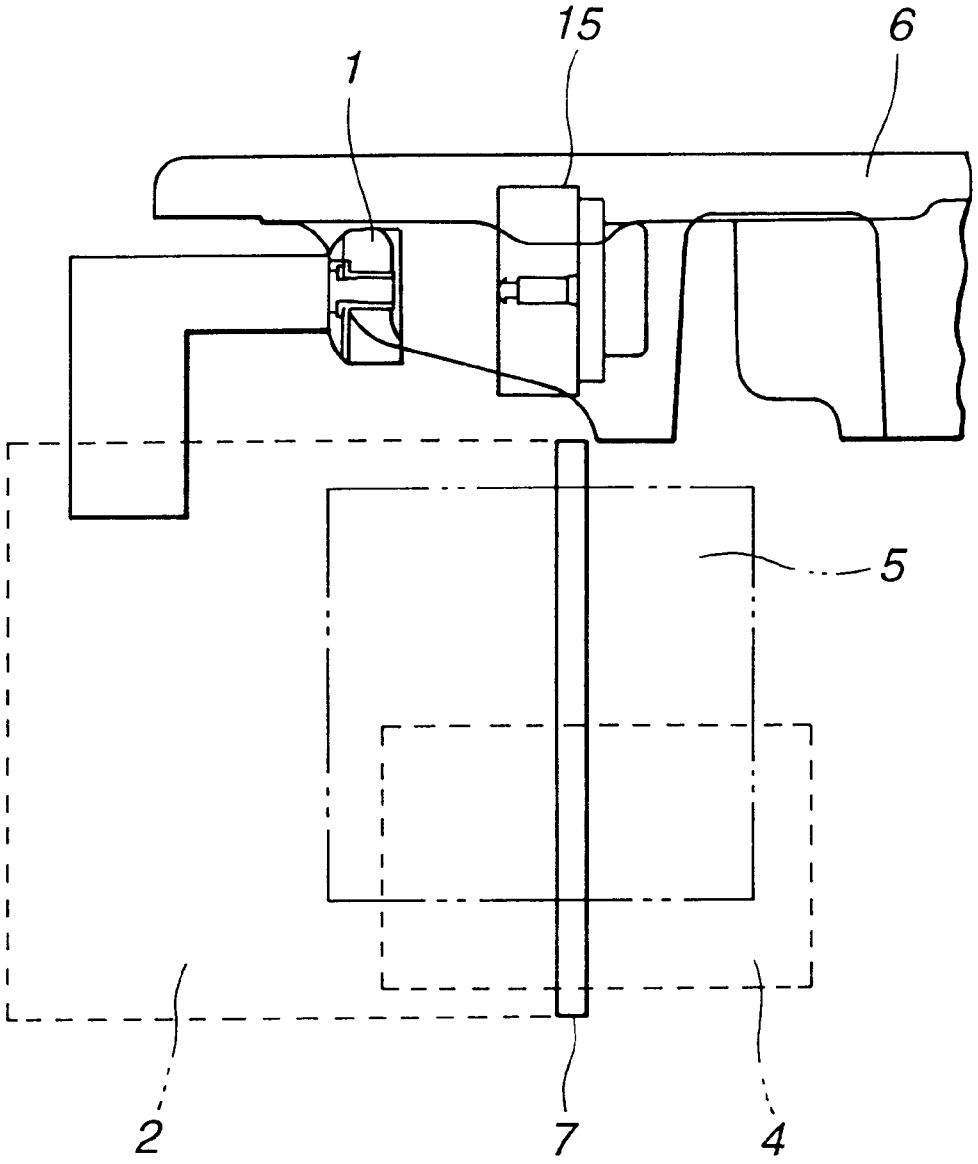
FIG. 9 is an explanatory side view of a conventional lower thread automatic supply device; and, FIG. 10 is an explanatory front view of the conventional lower thread automatic supply device shown in FIG. 9.
Figure 10:
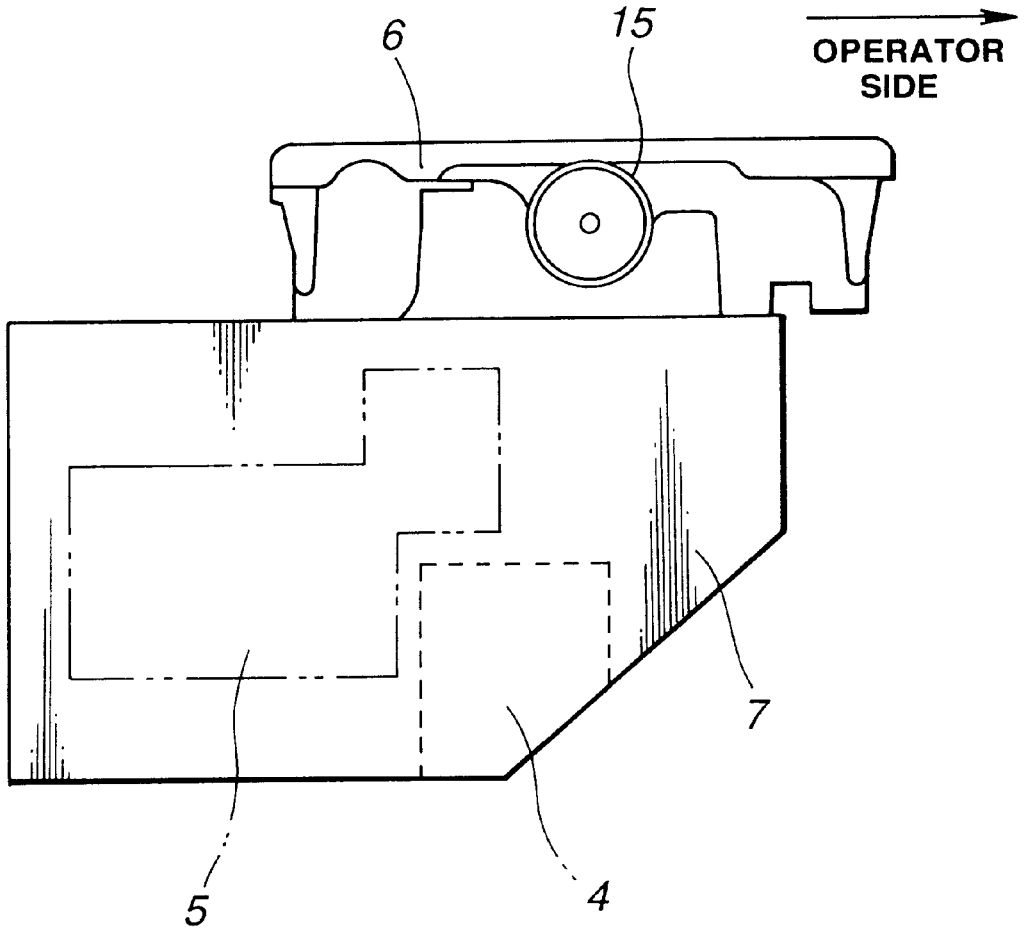

And, as shown in FIGS. 7 and 8, the mounting body 61 is fixed by four screws 63 respectively inserted into four screw holes 11*a* which are formed in the lower end face of the sewing machine bed 11. The fixation of the mounting body 61 to the screw holes 11*a* of the sewing machine bed 11 allows the mounting reference surfaces A, B and C to have their respective proper position relations with respect to the hook axis. This assures that, as previously described, the hold body 3 can be mounted properly onto the mounting body 61 mounted on the sewing machine bed 11 side; and thus the respective parts mounted on the hold body 3 can be positioned properly with respect to the hook axis. In a state where the hold body 3 is mounted on the mounting body 61, the opening 3*h* of the hold body 3 is almost coincide with the front portion or opening 61*f* of the mounting body 61, so that the front portion side of the hook 15 is made open.

Also, as shown in FIGS. 7 and 8, in a state where the mounting body 61 is mounted on the sewing machine bed 11 side, the opening 61*f* is situated under the hook 15 and thus the mounting portions 61*b* and 61*c* are respectively set at positions which are shifted or spaced left (on one side in the hook axial direction) from the hook 15. Such setting provides a wide space in front of the hook and also the opening 61*f* provides a wide space under the hook, which facilitates the maintenance of the hook from under the opening 61*f* and further prevents ill effects on the respective parts that otherwise could be caused by the dropping oil or cloth dust from the hook 15.

Also, in the above-mentioned embodiment, the bobbin replacing operation is executed by means of rotation. However, the invention can also apply similarly to another device which is structured such that the respective operations including the bobbin replacing operation and the like are carried out by means of linear motion.

As has been described heretofore, the lower thread automatic supply device is structured such that the second fixing means on the hold body side is fixed to the first fixing means provided on the sewing machine bed side, whereby the respective means of the bobbin replacing device can be disposed with high precision with respect to the hook and thus the bobbin case can be positively mounted onto and removed from the hook. Thanks to this structure, the present lower thread automatic supply device can be operated properly and stably for a long period of time and also can be mounted onto the sewing machine main body easily an accurately, thereby being able to enhance the reliability of the present lower thread automatic supply device.

And, the lower thread automatic supply device is structured in the following manner; that is, the lower thread automatic supply device is disposed in such a manner that it is shifted toward the deep side of the sewing machine, which makes it possible not only to eliminate the possibility that the cloth dust or oil dropping down from the hook and feed dog can attach directly onto the lower thread automatic supply device, thereby being able to keep the lower thread automatic supply device clean, but also to facilitate the maintenance of the hook and other similar operations; and also, the lower thread automatic supply device is formed as a unit to thereby be able to facilitate the assembling and replacing operations of the lower thread automatic supply device with respect to the sewing machine side. Thanks to this structure, the above-mentioned effect can be enhanced further.

Also, the lower thread automatic supply device is structured such that an operation space for the hook can be secured more widely due to provision of the opening in the second fixing means, so that not only the operations to be performed on the hook such as the maintenance thereof and the like can be facilitated further but also the structure of the lower thread automatic supply device can be simplified. With use of the present structure, the above-mentioned effect can be improved still further.

Further, the lower thread automatic supply device is structured in the following manner; that is, the lower thread automatic supply device is disposed in such a manner that it is shifted toward the outside of the sewing machine, which makes it possible not only to eliminate the possibility that the cloth dust or oil dropping down from the hook and feed dog can attach directly onto the lower thread automatic supply device, thereby being able to keep the lower thread automatic supply device clean, but also to secure a wide open space in front of the hook to thereby facilitate the maintenance of the hook and other similar operations. Therefore, with use of the present structure, the above-mentioned effect can be improved still further.

Still further, the lower thread automatic supply device is structured such that, simply by bringing the hold body side fixing means into contact with the mounting reference surfaces on the sewing machine main body side to thereby mount the former onto the latter, the delivery means can be disposed easily and with high precision with respect to the hook. This structure, in addition to the above-mentioned effect, can enhance the productivity of the lower thread automatic supply device.

Yet further, the lower thread automatic supply device is structured in the following manner: that is, the delivery means of the bobbin replacing device and other devices are respectively mounted through the hold body that is so disposed as to be shifted toward the outside of the sewing machine in the hook axial direction, there is eliminated the possibility that the cloth dust or oil dropping down from the hook and feed dog can attach directly onto the delivery means of the bobbin replacing device and other devices, thereby being able to keep clean the delivery means of the delivery means of the bobbin replacing device and other devices; the delivery means of the bobbin replacing device and other devices are respectively spaced apart from the sewing machine operator to thereby eliminate the danger that, when handling the sewing machine, the sewing machine operator can touch the delivery means of the bobbin replacing device and other devices; and, the hold body of the delivery means can be simply contacted with the mounting reference surfaces on the sewing machine main body side to thereby facilitate and simplify the mounting operation of the delivery means, so that the mounting precision of the delivery means with respect to the hook can be enhanced. Therefore, with use of the present structure, the reliability and productivity of the lower thread automatic supply device can be both improved.

And, the lower thread automatic supply device is structured in the following manner; that is, in addition to the delivery means of the bobbin replacing device employed in the lower thread automatic supply device as described above, the residual thread removing device and lower thread winding device are respectively disposed so that they are shifted toward the outside of the sewing machine in the hook axial direction, whereby there is eliminated the possibility that the cloth dust and oil dropping down from the hook and feed dog can attach directly to the residual thread removing device and lower thread winding device, in order to be able to keep clean the residual thread removing device and lower thread winding device; the residual thread removing device and lower thread winding device are spaced apart from the sewing machine operator to thereby eliminate the danger that, when handling the sewing machine, the sewing machine operator can touch the residual thread removing device and lower thread winding device; and, in addition to the above, the delivery means, residual thread removing device and lower thread winding device can be simply contacted with the mounting reference surfaces on the sewing machine main body side through the hold body, whereby the delivery means, residual thread removing device and lower thread winding device can be respectively positioned easily and with high precision with respect to the hook. The lower thread automatic supply device can be improved in both the reliability and productivity thereof.

Also, the lower thread automatic supply device is structured such that the bobbin replacing device, residual thread removing device and lower thread winding device can be positioned easily and with high precision in the hook axial direction, in the height direction and in the depth direction. Therefore, with use of the present structure, the effects of the invention as described above can be enhanced still further.

Further, the lower thread automatic supply device is structured such that the position of the lower thread automatic supply device can be adjusted by itself by operating the control amount setting and storing portion provided in the interior portion thereof. Therefore, with use of the present structure, the effects of the invention already described can be enhanced still further.

What is claimed is:

1. A lower thread automatic supply device for a sewing machine having a sewing machine bed and a hook below the sewing machine bed to accommodate a bobbin case with a bobbin, the lower thread automatic supply device comprising:

a bobbin replacing device including bobbin case-mounting and removing means for mounting the bobbin case onto the hook of the sewing machine and for removing the bobbin case from the hook, and delivery means for moving the bobbin case between the hook and a position spaced apart from the hook;

first fixing means disposed at a given position on the sewing machine bed with the hook used as reference therefor; and a hold body including second fixing means to be fixed to the first fixing means, wherein the bobbin case-mounting and removing means and the delivery means of the bobbin replacing device are fixedly disposed at their respective given positions with the second fixing means as reference therefor, wherein, if the first and second fixing means are fixed together, then the bobbin case-mounting and removing means and the delivery means of the bobbin replacing device fixedly disposed on the hold body are fixed at their respective given positions with the hook as reference therefor.

2. The lower thread automatic supply device according to claim 1, wherein the hold body is formed as a unit structured such that the bobbin replacing device is disposed farther on the opposite side of a sewing machine operator than the hook.

3. The lower thread automatic supply device according to claim 1, wherein the first fixing means is provided directly on the sewing machine bed and the second fixing means includes an opening which has an open space at least in front of the hook.

4. The lower thread automatic supply device according to claim 1, wherein the first fixing means includes an opening which has an open space at least downwardly of the hook, and the first fixing means is structured such that the hold body can be disposed at a position spaced apart from the hook in the axial direction of the hook.

5. The lower thread automatic supply device according to claim 1, wherein the first fixing means includes a mounting reference surface, wherein the second fixing means is contacted with the mounting reference surface to thereby dispose the rotation moving shaft of the delivery means at a position having a given position based on the position of the hook.

6. A lower thread automatic supply for a sewing machine having a hook to accommodate a bobbin case with a bobbin, the lower thread automatic supply device comprising:

a bobbin replacing device including bobbin case grip means for holding and releasing the bobbin case, and delivery means for moving the bobbin case between the hook and other devices, the delivery means of the bobbin replacing device being structured such that the delivery means rotates the bobbin case grip means about a given rotation moving shaft extending approximately in parallel to the axis of the hook to thereby move the bobbin replacing device and also that the delivery means moves the bobbin case grip means linearly along the rotation moving shaft, wherein the rotation moving shaft of the delivery means and the other devices are disposed spaced apart on the opposite side of a sewing machine operator with respect to a position just under the hook;

a hold body is disposed spaced apart by a given amount from the hook position toward the sewing machine outward side of the rotation moving shaft of the delivery means, and the delivery means is mounted on the hold body from the sewing machine outward side; and a mounting reference surface for mounting the hold body is provided on the sewing machine main body side, and the hold body is contacted with the mounting reference surface to thereby dispose the rotation moving shaft of the delivery means at a position having a given position relation with respect of the hook position.

7. The lower thread automatic supply device according to claim 6, wherein the other devices comprise a residual thread removing device for taking out a residual thread left on the bobbin stored within the bobbin case, and a lower thread winding device for winding a given amount of lower thread around the bobbin, and also wherein the residual thread removing device and the lower thread winding device are respectively disposed spaced apart from the position just under the hook on the opposite side of a sewing machine operator.

8. The lower thread automatic supply device according to claim 5, wherein the mounting reference surface includes an axial direction reference surface for positioning the delivery means in the direction of the axis of the hook, a height direction reference surface for positioning the delivery means in the vertical direction thereof within a plane intersecting the hook axis at right angles, and a longitudinal direction reference surface for positioning the delivery means in the depth direction thereof within the plane intersecting the hook axis at right angles.

9. The lower thread automatic supply device according to claim 2, wherein the bobbin replacing device includes a control amount setting and storing portion for setting the position relations of the respective parts of the bobbin replacing device with respect to the hook.

10. A lower thread automatic supply device for a sewing machine having a sewing machine bed and a hook below the sewing machine bed to accommodate a bobbin case with a bobbin, the lower thread automatic supply device comprising:

a bobbin replacing device including bobbin case-mounting and removing means for mounting the bobbin case onto the hook of the sewing machine and for removing the bobbin case from the hook, and delivery means for moving the bobbin case between the hook and a position spaced apart from the hook;

a hold body which includes first positioning means disposed at a given position on a sewing machine bed with the hook as reference therefor, and second positioning means engageable with the first positioning means to thereby be able to position the hold body, and also on which the respective means of the bobbin replacing device are fixedly disposed at their respective given positions with the second positioning means as reference therefor; and a fixing member for fixing the hold body to the sewing machine bed while the hold body is positioned by the first and second positioning means.

11. The lower thread automatic supply device according to claim 10, wherein the hold body is formed as a unit structured such that the bobbin replacing device is disposed farther on the opposite side of a sewing machine operator than the hook.

12. The lower thread automatic supply device according to claim 10, wherein the first positioning means is formed integrally with the sewing machine bed.

13. The lower thread automatic supply device according to claim 10, wherein the first positioning means is disposed on a mounting body which is fixed at a given position on the sewing machine bed with the hook as reference therefor.

14. The lower thread automatic supply device according to claim 13, wherein the first positioning means is disposed spaced from the hook forwardly in the axial direction of the hook, and the mounting body has an opening providing an open space downwardly of the hook.

15. The lower thread automatic supply device according to claim 10 wherein the first positioning means has an opening providing an open space in front of the hook.

16. The lower thread automatic supply device according to claim 15, wherein the second positioning means has a second opening which communicates with the opening of the first positioning means to thereby provide an open space in front of the hook.

17. The lower thread automatic supply device according to claim 10, wherein the first positioning means includes a reference surface for positioning the hold body in the axial direction position of the hook, a reference surface for positioning the hold body in the lateral direction of the hook intersecting the hook axial direction at right angles, and a reference surface for positioning the hold body in the longitudinal direction position of the hook intersecting the hook axial direction at right angles, and also wherein the second positioning means includes engaging surfaces which are engaged with the reference surfaces of the first positioning means respectively.

18. The lower thread automatic supply device according to claim 6, wherein the mounting reference surface includes an axial direction reference surface for positioning the delivery means in the direction of the axis of the hook, a height direction reference surface for positioning the delivery means in the vertical direction thereof within a plane intersecting the hook axis at right angles, and a longitudinal direction reference surface for positioning the delivery means in the depth direction thereof within the plane intersecting the hook axis at right angles.

19. The lower thread automatic supply device according to claim 6, wherein the bobbin replacing device includes a control amount setting and storing portion for setting the position relations of the respective parts of the bobbin replacing device with respect to the hook.

20. The lower thread automatic supply device according to claim 11, wherein the first positioning means has an opening providing an open space in front of the hook.

21. The lower thread automatic supply device according to claim 12, wherein the first positioning means has an opening providing an open space in front of the hook.

22. The lower thread automatic supply device according to claim 13, wherein the first positioning means has an opening providing an open space in front of the hook.

23. The lower thread automatic supply device according to claim 14, wherein the first positioning means has an opening providing an open space in front of the hook.

* * * * *